US009636829B2

(12) United States Patent
Taylor

(10) Patent No.: US 9,636,829 B2
(45) Date of Patent: May 2, 2017

(54) KNIFE WITH ADJUSTABLE SCALES

(71) Applicant: Spyderco, Inc., Golden, CO (US)

(72) Inventor: Bruce R. Taylor, Sagle, ID (US)

(73) Assignee: Spyderco, Inc., Golden, CO (US)

( * ) Notice: Subject to any disclaimer, the term of this patent is extended or adjusted under 35 U.S.C. 154(b) by 52 days.

(21) Appl. No.: 14/552,820

(22) Filed: Nov. 25, 2014

(65) Prior Publication Data

US 2015/0239136 A1 Aug. 27, 2015

Related U.S. Application Data

(60) Provisional application No. 61/945,419, filed on Feb. 27, 2014.

(51) Int. Cl.

| | |
|---|---|
| ***B26B 3/00*** | (2006.01) |
| ***B25G 1/04*** | (2006.01) |
| ***B26B 1/10*** | (2006.01) |
| ***B25G 1/10*** | (2006.01) |

(52) U.S. Cl.

CPC ..... *B26B 3/00* (2013.01); *B25G 1/102* (2013.01); *B26B 1/10* (2013.01); *Y10T 29/49817* (2015.01)

(58) Field of Classification Search

CPC .. B25G 1/102; B25G 3/00; B25G 3/02; B26B 1/10; B26B 3/00; Y10T 29/49817

USPC ..... 30/344

See application file for complete search history.

(56) References Cited

U.S. PATENT DOCUMENTS

| | | | | |
|---|---|---|---|---|
| 3,747,211 | A * | 7/1973 | Calabrese | B26B 3/00 30/155 |
| 4,184,248 | A * | 1/1980 | Wolfe | B26B 3/06 30/340 |
| 4,233,737 | A * | 11/1980 | Poehlmann | B26B 1/042 30/161 |
| 4,470,327 | A * | 9/1984 | Gerber, Jr. | B26B 3/00 30/344 |
| 4,805,303 | A * | 2/1989 | Gibbs | B26B 11/001 30/155 |
| 5,398,360 | A * | 3/1995 | Alexander | B26B 3/06 30/143 |
| 5,689,889 | A * | 11/1997 | Overholt | B26B 5/00 30/329 |
| 5,802,722 | A * | 9/1998 | Maxey | B26B 1/046 30/160 |
| 5,873,148 | A * | 2/1999 | Arnold | B25G 1/043 16/422 |
| 8,707,490 | B1 * | 4/2014 | Pelton | B26B 1/00 30/123 |
| 2006/0112565 | A1 * | 6/2006 | Moser | B26B 3/06 30/151 |

(Continued)

FOREIGN PATENT DOCUMENTS

| | | |
|---|---|---|
| FR | 2 807 687 | * 10/2001 |
| WO | WO 2008/141737 A1 | * 11/2008 |

*Primary Examiner* — Hwei C Payer

(74) *Attorney, Agent, or Firm* — Sheridan Ross P.C.

(57) ABSTRACT

A knife is provided that has at least one scale with multiple layers. A user can remove these layers to achieve the proper knife handle thickness. Further, the user may add various top layers to accommodate different applications of the knife. These features improve the utility of the knife and lower the cost for the user because the user does not have to buy multiple knives with different handle sizes and different handle types.

11 Claims, 8 Drawing Sheets

(56) References Cited

U.S. PATENT DOCUMENTS

| | | | | |
|---|---|---|---|---|
| 2012/0017442 | A1* | 1/2012 | King | B26B 1/02 30/155 |
| 2012/0304470 | A1* | 12/2012 | Freeman | B26B 1/046 30/159 |
| 2015/0217461 | A1* | 8/2015 | Langenwalter | B26B 1/042 7/118 |
| 2015/0239136 | A1* | 8/2015 | Taylor | B25G 1/102 30/165 |
| 2016/0046017 | A1* | 2/2016 | Wood | B26B 3/00 30/123 |

* cited by examiner

KNIFE WITH ADJUSTABLE SCALES

CROSS REFERENCE TO RELATED APPLICATIONS

This application claims priority under 35 U.S.C. §119 to U.S. Provisional Patent Application Ser. No. 61/945,419 filed Feb. 27, 2014, which is incorporated herein in its entirety by reference.

FIELD OF THE INVENTION

The present invention relates to implements with handles and more specifically to knives with an adjustable handle or scales.

BACKGROUND OF THE INVENTION

Cutting instruments have been used for centuries by craftsmen, hunters, and others who require a sharp edge, or other features, in their desired activity. Most cutting instruments, including knives, incorporate a handle to improve the utility of the knife. A user can more easily wield a knife with a handle, and a handle prevents the user from contacting the sharp edge of the knife. While knife handles improve utility, a knife handle on a given knife comes in one size and one style to simplify the manufacturing process. A knife handle with a single size and style limits the usefulness of the knife because the knife handle may not suit all users or all applications of the knife.

One particular issue that arises with a single knife handle is that it cannot accommodate the extremely variable dimensions of the human hand. In a recent study of hand size based on a sample of 250 students over 18 years of age, the length of the hand varied from 14.8 cm to 21.0 cm, and the breadth of the hand varied from 6.6 cm to 9.4 cm. Agnihotri et al., *Determination Of Sex By Hand Dimensions*, Internet J. of Forensic Sci., 1:2 (2005). Even if a knife handle were designed for the median or mean hand dimensions, a person who has smaller or larger hands will be at a disadvantage and will not be able to use the knife effectively.

Another issue with a knife that has a single handle is that a given knife may be used in a wide variety of applications. A knife may be used for underwater purposes, for hunting or cleaning game, in the kitchen, for woodworking, etc. A knife that has one type of handle may not be as effective in each application because each application has different requirements. For example, a knife handle may require hydrophobic properties or improved grip features for underwater use, and a knife handle may need antimicrobial properties when used in the kitchen. A material or type of knife handle cannot be optimized for an unlimited number of applications.

It would be cost prohibitive for a user to buy a knife with a properly dimensioned handle for each application. First, if a manufacturer had to produce a range of handle sizes instead of a single handle size, it would increase the cost of the knife. Second, if a user had to purchase a separate knife for each application, each knife having a handle optimized for a particular application, then it would result in an increased cost for the user. Therefore, there is a need for a knife or hand tool handle that can address these and other issues.

SUMMARY OF THE INVENTION

It is thus an aspect of embodiments of the present invention to provide an implement with an adjustable handle or scales to suit a variety of hand dimensions and applications. It is a further aspect of embodiments of the present invention to improve the effectiveness of the implement and to reduce the likelihood of injury. A knife is used for exemplary purposes to describe the various aspects and embodiments of the present invention, but aspects and embodiments may be applied to any implement or hand tool with a handle.

One aspect of embodiments of the present invention is to optimize the thickness of the handle of the knife for a given person's hand dimensions. For example, a user may optimize the thickness of a handle by choosing the appropriate number of scales to create a custom-sized handle. When a user has a knife with a knife handle that is suited to his or her hand dimensions, then the user has a more secure grip on the knife and can use the knife with finer precision. This also means that a user will be less likely to injure himself or herself. With a more secure grip, there is less risk that the knife will become dislodged during use and result in injury to the user.

A further aspect of embodiments of the present invention is a quick and efficient way to removably attach one or more scales to the tang end of a knife. This may be accomplished with screws, bolts, adhesives, clamps, etc. In one embodiment, the tang end of a knife comprises at least one recess wherein a portion of the recess is covered and another portion of the recess is an aperture. The inner face of a scale comprises a protrusion that enters the aperture portion of the recess, continues into the covered portion of the recess, and snaps into place such that the scale is removably attached to the tang end of the knife. One skilled in the art will appreciate a variety of snap fit connections between the tang end of an implement and a scale and between a scale and a scale.

Another aspect of embodiments of the present invention is to provide a knife with an adjustable handle or scales to accommodate different usages of the knife. Knife handles can have many characteristics such as material texture that render the knife handle effective for a particular application. The present invention provides a user with the option to change knife handles to suit a particular job. For example, a user may require a textured polymer handle when using the knife underwater, but then require a smooth plastic handle with antimicrobial properties when using the knife in a kitchen.

A further aspect of embodiments of the present invention is to provide a quick and useful means to adjust the knife handle. A user may frequently switch between types of knife handles or even different users, and thus require a system or configuration that allows for quick and simple changing of knife handles. Alternatively, a user may switch a knife handle infrequently due to fewer users and applications. In this instance, a user may require a more durable and long-lasting connection between the knife and the knife handle.

One embodiment of the present invention includes a knife handle with a plurality of scales. A user may optionally and/or selectively remove scales until the desired thickness, contour, or geometry of the handle is achieved. Then, the user may secure the remaining scales to a tang end, or back portion, of the knife. In other embodiments of the present invention the scales are secured to other portions of the knife. For example, the remaining scales may be secured to the back spacer of a folding knife. The resulting knife handle has a thickness and shape that is optimized for the particular hand dimensions of the user, which improves the utility and safety of the knife.

In one embodiment of the present invention, the knife comprises a first scale assembly on one side, a first side, of the blade. The first scale assembly comprises a combination of scales, including stacking scales and a top scale. The stacking scales provide width to the first scale assembly such that a user may optionally remove some of the stacking scales to adjust the width of the first scale assembly, and in turn, the width of the knife handle. The top scale also provides width in the first scale assembly, and it also provides the surface that the user will grasp when using the knife. Therefore, the top scale has characteristics that make it suited for a particular use or application. For example, the top scale may be made from a particular material with a particular texture. Beyond the first scale assembly, the other side of the blade, a second side, may comprise a number of features. This includes, but is not limited to, a second scale assembly that comprises at least one stacking scale and a top scale, a single scale, or no scales at all.

In an embodiment of the present invention, the tang end of the blade, the stacking scales, and the top scales have fastener apertures arranged in a staggered configuration, which means that fastener apertures on one side of the tang end of the blade do not align with fasteners on the opposite side of the tang end of the blade. Fasteners such as screws help secure the top scales and the stacking scales to the tang end of the blade or the back spacer of a folding knife. A staggered fastener aperture configuration allows for greater range of adjustment when the user adds or subtracts stacking scales from the present invention. In this configuration, a fastener such as a screw may pass through the fastener aperture of the top scale, the stacking scales, and into the tang end of the blade or the back spacer of a folding knife. Therefore, as a user removes stacking scales and the width of the handle decreases, the screw may continue to pass through the tang end of the blade, or the back spacer of a folding knife, and into the stacking scales on the other side of the tang end without interference from another screw.

A specific embodiment of the present invention is a handtool having an adjustable handle, wherein the overall thickness and contour of the adjustable handle may be selectively altered, comprising a handtool having a handle end, a working end opposite the handle end, a first side, and a second side opposite the first side, wherein the handle end has a width, and wherein a first scale assembly is disposed on the handle end and comprises at least one stacking scale, wherein each stacking scale has a width; and a top scale having a width, wherein the top scale is disposed on the outermost stacking scale.

Another embodiment of the present invention is a method of controlling the width of a knife handle, comprising providing a blade having a blade end, a tang end opposite the blade end, a first side, and a second side opposite the first side, wherein the tang end has a width and at least one fastening aperture; providing a plurality of first stacking scales disposed on the first side of the tang end of the blade, the plurality of stacking scales having at least one fastening aperture; selecting the width of the knife handle and optionally removing at least one first stacking scale; providing a first top scale disposed on the outermost first stacking scale, the first top scale having at least one fastening aperture; and securing the first top scale and the plurality of first stacking scales to the first side of the tang end of the blade with a fastening feature through the at least one fastening aperture of the first top scale, the plurality of first stacking scales, and the tang end of the blade, wherein the shape of the knife handle is modified to fit a user's hand.

Yet another embodiment of the present invention is a knife with a handle having selectively adjustable scales comprising a blade having a blade end, a tang end opposite the blade end, a first side, and a second side opposite the first side, wherein the tang end has a width; a first scale assembly interconnected to the first side of the tang end of the blade, wherein the first scale assembly comprises at least one stacking scale, wherein each stacking scale has a width, an inner side facing towards the first side of the tang end, and an outer side facing away from the first side of the tang end; a top scale having a width, an inner side facing towards the first side of the tang end, and an outer side facing away from the first side of the tang end, wherein the inner side of the top scale is disposed on the outer side of the outermost stacking scale; a second scale assembly interconnected to the second side of the tang end of the blade, wherein the second scale assembly comprises: at least one stacking scale, wherein each stacking scale has an inner side facing towards the second side of the tang end and an outer side facing away from the second side of the tang end; a top scale having an inner side facing towards the second side of the tang end and an outer side facing away from the second side of the tang end, wherein the inner side of the top scale is disposed on the outer side of the outermost stacking scale; and wherein the first scale assembly, the second scale assembly, and the tang end of the blade comprise fastening apertures, and wherein the fastening apertures of the first scale assembly align with the fastening apertures of the second scale assembly.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary of the Invention given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Figure 1:
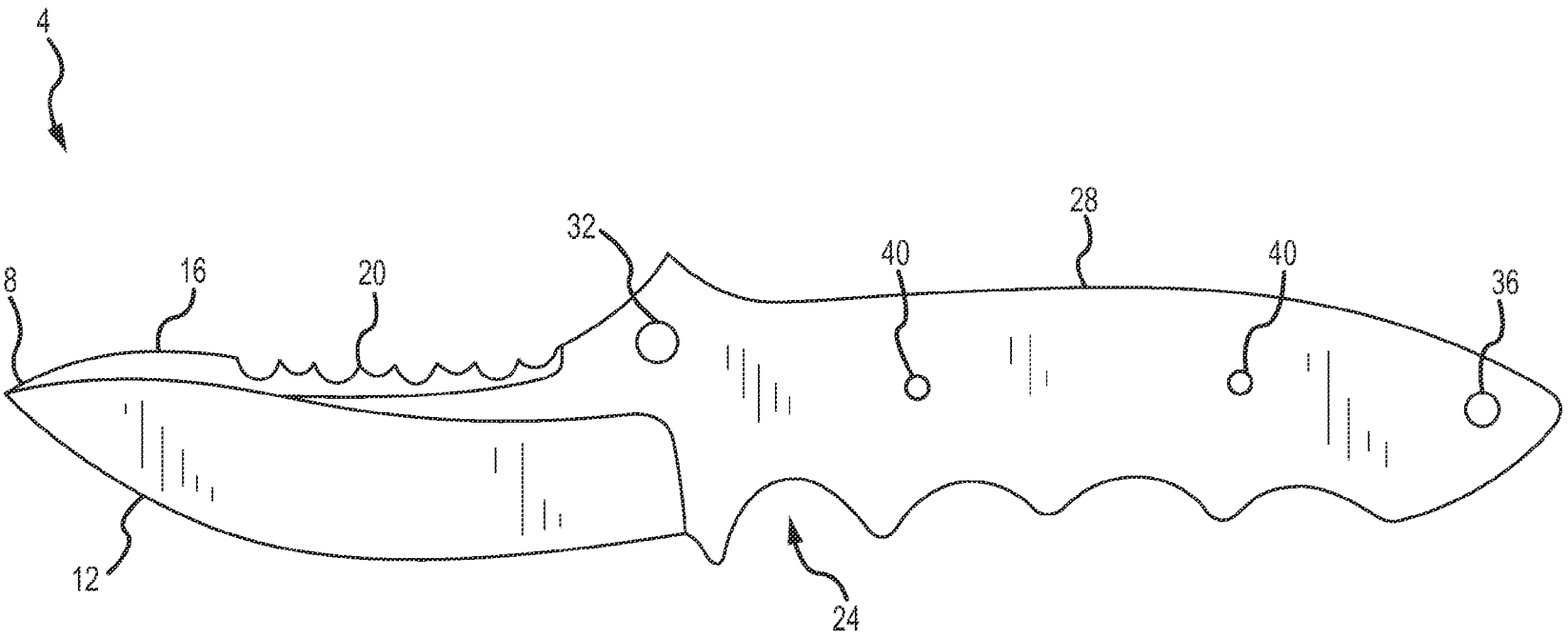
FIG. 1 is an elevation view of an embodiment of a knife configured to accommodate an adjustable handle or scales.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

A list of the various components shown in the drawings and associated numbering is provided herein:

| Component No. | Component |
|---|---|
| 4 | Knife |
| 8 | Blade |
| 12 | Cutting Edge |
| 16 | Spine |
| 20 | Serrated Edge |

-continued

| Component No. | Component |
|---|---|
| 24 | Choil |
| 28 | Tang End |
| 32 | First Aperture |
| 36 | Second Aperture |
| 40 | Fastener Aperture |
| 44 | First Top Scale |
| 48 | Second Top Scale |
| 52 | First Stacking Scale |
| 56 | Second Stacking Scale |
| 60 | First Fore Column |
| 64 | First Center Column |
| 68 | First Aft Column |
| 72 | Second Fore Column |
| 76 | Second Center Column |
| 80 | Second Aft Column |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures depict knives with adjustable handles, the present invention is not limited to these embodiments.

Referring now to the drawings, FIG. 1 shows a side elevation view of a knife 4 configured to accommodate an adjustable handle or scales. The knife 4 generally comprises a blade 8, which has a cutting edge 12 that is typically a flat sharpened edge. Opposite the cutting edge 12 is a spine 16 of the blade 8. In this embodiment of the invention, an additional serrated edge 20 is located on the spine 16 of the blade 8. One skilled in the art will appreciate that the blade 8 may comprise features such as bevels, serrations, or any other feature that is commonly included on the cutting edge 12 or the spine 16.

Located proximate the cutting edge 12 of the blade 8 is the choil 24. This feature may assist a user in gripping the knife 4 and may be adapted to receive a user's fingers, which can enhance the user's grip when cutting, thrusting, and stabbing. Located proximate the spine 16 of the blade 8 is a first aperture 32, which provides a number of advantages. For example, a user may locate a thumb on the aperture 32 to give the user additional control and assist the user in wielding the knife 4.

The end of the blade 8 opposite the cutting edge 12 and spine 16 is referred to as the tang end 28. The tang end 28 provides a location for the adjustable handle or scales to interconnect to the blade 8. Further, the tang end 28 provides balance to the blade 8, which allows a user to more easily wield the knife 4. In this embodiment, two fastener apertures 40 are located on the tang end 28. These fastener apertures 40 provide a location where an adjustable handle or scales may interconnect to the blade 8 and form a complete knife 4. One skilled in the art will appreciate that the present invention is not limited to two fastener apertures 40. It may be advantageous to have more or fewer fastener apertures 40, including no fastener apertures 40, depending on a user's requirements for the present invention.

In this embodiment, a second aperture 36 is also located on the tang end 28 of the blade 8. This second aperture 36 is sometimes referred to as a lanyard hole. A user may thread material through the second aperture 36 to secure the tang end 28 of the blade 8 to a sheath, belt, harness, or any other location that helps the user secure the knife 4.

The knife 4 depicted in FIG. 1 is a fixed blade knife, but the present invention is not limited to such. Other embodiments of the present invention include, for example, folding knives. The tang end 28 of the blade 8 in a folding knife pivots about a pin located between the two scales. Also disposed between the two scales is a back spacer, which provides depth to the knife handle such that the blade 8 may be partially disposed within a cavity or recess in the knife handle when the folding knife is in the closed position. Further, the back spacer provides a stop surface upon which the blade 8 rests when the folding knife is in the open position. The back spacer provides a necessary obstacle to prevent the blade 8 from being driven upward when a significant force is applied to the cutting edge 12 of the blade 8. Thus, fastener apertures 40 may be located on a back spacer for purposes of the present invention.

Figure 2A:
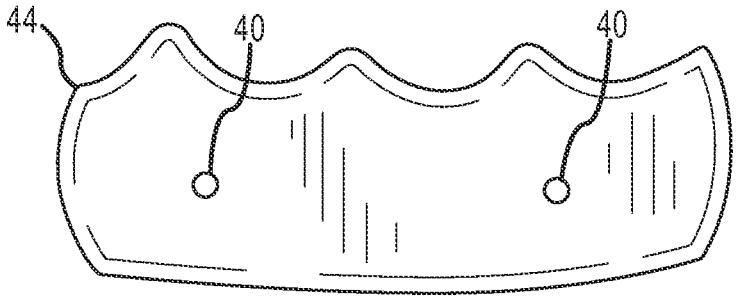
FIG. 2A is a front elevation view of a first top scale.
Figure 2B:
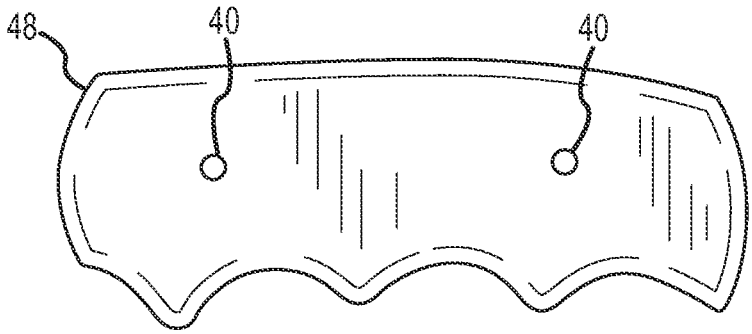
FIG. 2B is a front elevation view of a second top scale.

Now referring to FIGS. 2A and 2B, this embodiment of the invention has a first top scale 44 and a second top scale 48. These top scales 44, 48 comprise finger grooves that allow a user to obtain a secure grip on the knife 4. Other embodiments of the present invention may have other configurations of finger grooves, finger holes, or any other grip feature commonly known in the art.

Figure 3A:
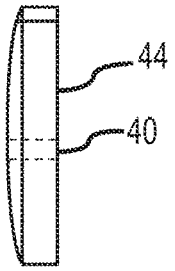
FIG. 3A is a side elevation view of the first top scale in FIG. 2A.
Figure 3B:
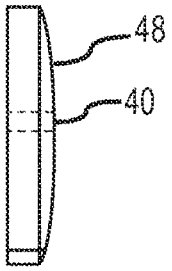
FIG. 3B is a side elevation view of the second top scale in FIG. 2B.

Now referring to FIGS. 3A and 3B, side elevation views of the top scales 44, 48 of FIGS. 2A and 2B are provided. As shown, one edge of the top scales 44, 48 comprises a rounded, three-dimensional shape which fits more snuggly into a user's hand. This fit provides greater surface area contact between the knife 4 and the user's hand, and thus, the user has a more secure grip on the knife 4. In other embodiments, the top scales 44, 48 may comprise flat edges when view from the side elevations view of FIGS. 3A and 3B. In these embodiments, the top scales 44, 48 may be cheaply manufactured from metal slabs.

Figure 4A:
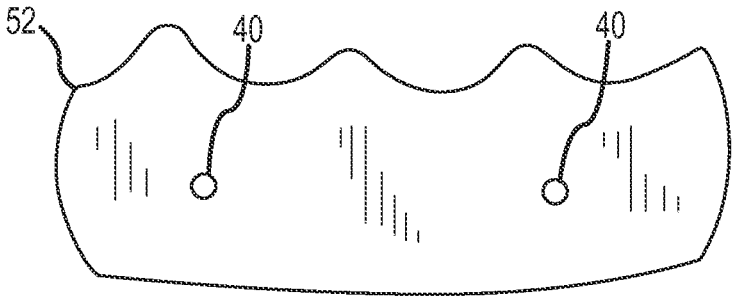
FIG. 4A is a front elevation view of a first stacking scale.
Figure 4B:
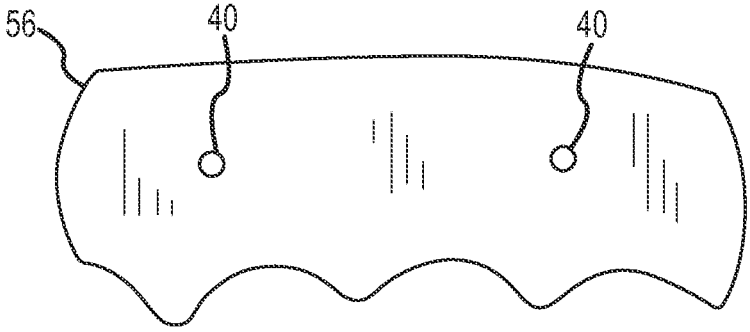
FIG. 4B is a front elevation view of a second stacking scale.
Figure 5A:
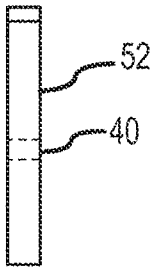
FIG. 5A is a side elevation view of the first stacking scale of FIG. 4A.
Figure 5B:
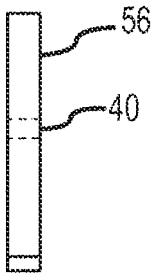
FIG. 5B is a side elevation view of the second stacking scale of FIG. 4B.

Now referring to FIGS. 4A-5B, a first stacking scale 52 and a second stacking scale 56 is provided. Similar to the top scales 44, 48, the stacking scales 52, 56 as shown in FIGS. 4A and 4B comprise finger grooves and may comprise other features such as finger holes or any other grip feature commonly known in the art. FIGS. 5A and 5B show a side elevation view of the stacking scales 52, 56, both of which comprise flat edges. The stacking scales 52, 56 interface with the flat side of the top scales 44, 48 as depicted in FIGS. 3A and 3B as well as the flat side of the tang end 28 of the blade 8. In other embodiments, the stacking scales 52, 56 may comprise non-flat side to help locate the top scales 44, 48, stacking 52, 56, and/or the tang end 28 of the blade 8 relative to one another. In further embodiments, the stacking scales 52, 58 may comprise features such as a notch, a rib, a recess, a depression, a protrusion, an aperture, or any other similar feature to locate the stacking scales 52, 58 with other stacking scales, 52, 58, top scales, 44, 48, and/or the tang end 28 of the blade 8.

Figure 6:
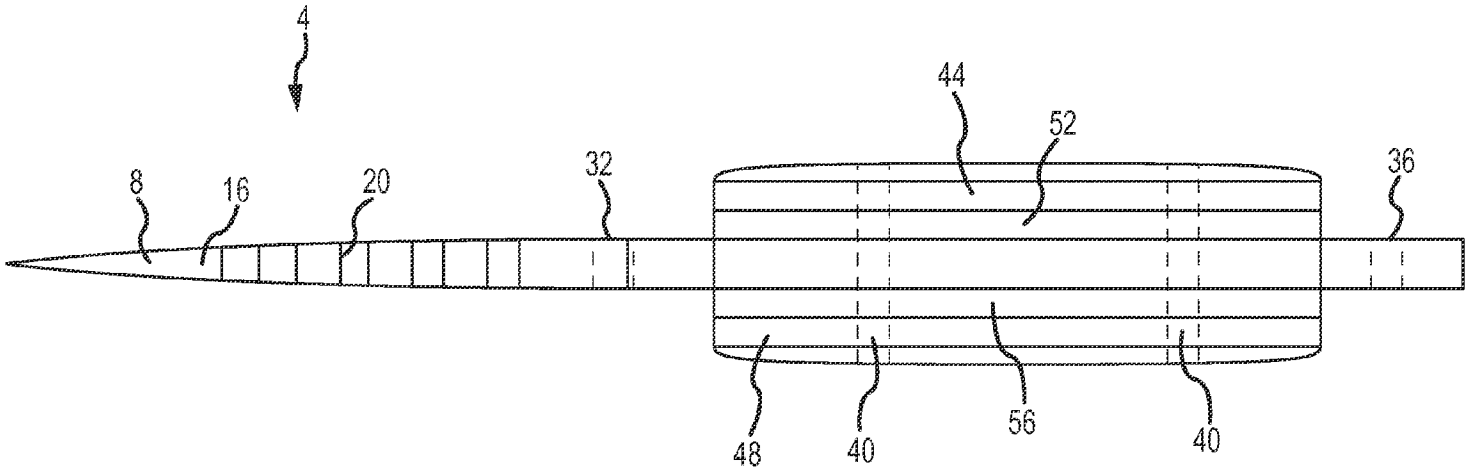
FIG. 6 is a top plan view of a knife with adjustable scales wherein the scale apertures are aligned.

Now referring to FIG. 6, a top plan view of the knife 4 in FIG. 1 is provided. A first stacking scale 52 is disposed between the first top scale 44 and the tang end 28 of the blade 8, and a second stacking scale 56 is disposed between the second top scale 48 and the tang end 28 of the blade 8. In this embodiment, there is only one stacking scale 52, 56 on either side of the tang end 28 of the blade 8. However, other embodiment may comprise one or more stacking scales 52, 56 on one or both sides of the tang end 28 of the blade 8. When a user wants to adjust the width of the knife handle, he or she may remove or add stacking scales 52, 56 between the tang end 28 of the blade 8 and the top scales 44, 48.

The top scales 44, 48 and the stacking scales 52, 56 each have two fastener apertures 40, which correspond to the two fastener apertures 40 on the tang end 28 of the blade 8. It may be advantageous to have more or fewer fastener apertures 40, including no fastener apertures 40, depending on a user's requirements for the present invention. The fastener apertures 40 may be arranged in numerous configurations. In the embodiment depicted in FIGS. 1-5B the fastener apertures 40 on the top scales 44, 48, the stacking scales 52, 56, and the tang end 28 of the blade 8 align on two axes. In other words, a screw could potentially pass through one fastener aperture 40 on the first top scale 44, through the first stacking scale 52, the tang end 28 of the blade 8, the second stacking scale 56, and through the fastener aperture 40 of the second top scale 48.

However, in this aligned configuration two screws may be used, one to secure the first top scale 44 and the first stacking scale 52 to the tang end 28 of the blade 8, and one screw to secure the second top scale 48 and the second stacking scale 56 to the tang end 28 of the blade 8. Thus, the screw that secures the first top scale 44 and the first stacking scales 52 could not extend past the tang end 28 of the blade 8 because the screw would eventually contact the screw that secures the second top scale 48 and its second stacking scales 56. In the aligned configuration or other configurations, the present invention may include various screw lengths so that when a user removes stacking scales 52, 56 a shorter screw is used to secure the knife handle. Likewise, when a user adds stacking scales 52, 56 a longer screw may be used to secure the top scales 44, 48 and the stacking scales 52, 56 to the tang end 28 of the blade 8. One skilled in the art will appreciate further fastener aperture 40 configurations beyond the aligned and staggered configurations that are advantageous.

Figure 7:
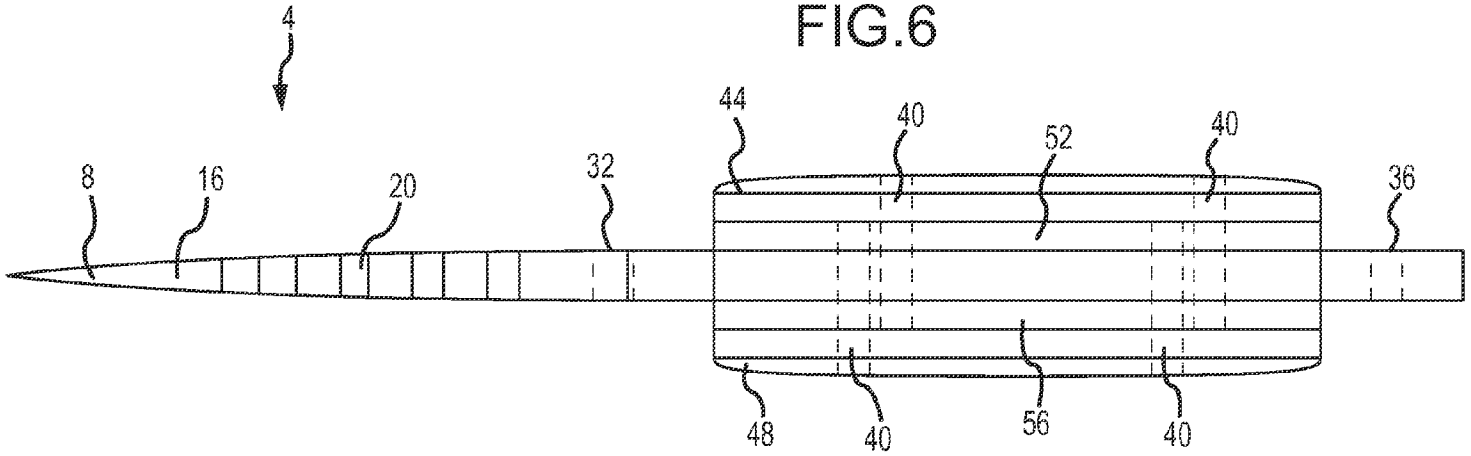
FIG. 7 is a top plan view of a knife with adjustable scales wherein the scale apertures are staggered.

Now referring to FIG. 7, an embodiment of the knife 4 is provided where the fastener apertures 40 are in a staggered configuration. This means that two fastener apertures 40 in the first top scale 44 that do not align with two fastener apertures 40 in the second top scale 48 would result in four fastener apertures 40 in the tang end 28 of the blade 8.

Staggered fastener apertures 40 allow for greater variation in handle thickness. For example, a screw that secures the first top scale 44 and any first stacking scale 52 to the tang end 28 of the blade 8 via fastener apertures 40 may extend past the tang end 28 of the blade 8. Therefore, if a user removes the first stacking scale 52, the screw may extend through the tang end 28 of the blade 8 and into the second stacking scale 56 or the top scale 48 on the other side of the tang end 28 of the blade 8.

Various embodiments of the present invention include features and materials to secure the top scales 44, 48 and the stacking scales 52, 56 to the tang end 28 of the blade 8 of the knife 4. Quick and simple solutions for securing includes fasteners such as bolts and screws, which includes various screw types such as flat, phillips, hex, Torx®, spanner, and others. More permanent or semi-permanent methods for securing include adhesives and rivets. In one embodiment, the tang end 28 of the blade 8 comprises at least one recess wherein a portion of the recess is covered by a portion of the tang end 28, forming a partially enclosed volume. Another portion of the recess is an aperture or open volume portion of the tang end 28. The inner face of a stacking scale 52, 56 may comprise a protrusion that enters the aperture portion of the recess, continues into the covered portion of the recess and enters the partially enclosed volume. As the protrusion continues, the geometry of the recess and the protrusion forces the stacking scale 52, 56 to snap to the tang end 28 of the blade 8. One skilled in the art will appreciate a number of fasteners in the art commonly used to secure components together.

FIG. 7 shows the top scales 44, 48 located on the outside of the knife handle, and the stacking scales 52, 56 disposed between the top scales 44, 48 and the tang end 28 of the blade 8. The stacking scales 52, 56 have an inner side and an outer side. The inner side faces towards the tang end 28, and the outer sides face away from the tang end 28. Likewise, the top scales 44, 48 have an inner side that faces towards the tang end 28 and an outer side that faces away from the tang end 28. The stacking scales 52, 56 are assembled on one side of the tang end 28 with all inner sides facing towards the tang end 28. Then, a top scale 44, 48 is disposed on the outermost stacking scale 52, 56 such that when a user grasps the handle of the knife 4, he or she is grasping the top scale 44, 48.

The scales may come in a variety of shapes, textures, and sizes. The width of the scales may be expressed in terms of the width of the tang end 28 of the blade 8. In one embodiment the width of the stacking scales 52, 56 is between approximately 5% and 200% the width of the tang end 28 of the blade 8. In a more preferred embodiment, the width of the stacking scales 52, 56 is between approximately 30% and 90% the width of the tang end 28 of the blade 8. In another preferred embodiment, the width of the stacking scales 52, 56 is greater than 5% the width of the tang end 28 of the blade 8. In a most preferred embodiment, the width of the stacking scales 52, 56 is approximately 60% the width of the tang end 28 of the blade 8. One who is skilled in the art will appreciate that if there is more than one stacking scale 55, 56, the width of the stacking scales 52, 56 may be different from one another.

The scales may also come in a variety of shapes. In some of the embodiments of the present invention, the first and second side of the tang end 28 of the blade 8, the inner and outer sides of the stacking scales 52, 56, and the inner and outer sides of the top scales 44, 48 are substantially planar. This simplifies the manufacturing process because all of the aforementioned components can be made from slabs of material. Further, the substantially planar surfaces allow for a large contact between areas of the respective surfaces, and thus a stable interface between the various components of the knife 4.

In other embodiments of the present invention, the outer surface of the top scales 44, 48 may not be substantially planar as depicted in FIGS. 2A-3B. For example, the outer side of the top scales 44, 48 may be rounded to provide a more ergonomic grip for the user. The rounded shape of the outer side of the top scales 44, 48 may be expressed in terms of radius of curvature. In one embodiment, the radius of curvature of the top scales 44, 48 is between approximately 1 inch and 15 inches. In a preferred embodiment, the radius of curvature of the top scales 44, 48 is between approximately 6 inches and 8 inches. In another preferred embodiment, the radius of curvature of the top scales 44, 48 is 1 inch or greater. In a most preferred embodiment, the radius of curvature is approximately 7 inches. One skilled in the art will appreciate that the first top scale 44 and the second top scale 48 can have different radii of curvature, including the outer surface of one top scale 44, 48 being substantially planar.

In further embodiments, the inner and outer surfaces of the stacking scales 52, 56 and the inner surface of the top scales 44, 48 may not be substantially planar. A substantially non-planar surface may aid in setting and aligning the tang end 28 of the blade 8, the stacking scales 52, 56, and the top scales 44, 48 while preserving or increasing the contact area between components. The inner and outer surfaces of the stacking scales 52, 56 and the inner surface of the top scales 44, 48 may come in a variety of shapes. For example, the surfaces may be rounded with a constant radius of curvature, which will aid the user in aligning the stacking scales 52, 56 and the top scales 44, 48 with the tang end 28 of the blade 8. In another example, the surfaces may comprise a protrusion and/or depression to aid the user in alignment. The tang end 28 of the blade 8 and the outer surfaces of the stacking scales 52, 56 may comprise a protrusion, and the inner surfaces of the stacking scales 52, 56 and the top scales 44, 48 may comprise a depression to aid the user in alignment. One skilled in the art will appreciate that the various surfaces of the tang end 28 of the blade, the stacking scales 52, 56, and the top scales 44, 48 need not be the same shape, substantially non-planar or otherwise.

The width of the top scales 44, 48 may also be expressed in terms of the width of the tang end 28 of the blade 8. The top scales 44, 48 may come in a variety of shapes, thus the width of the top scales 44, 48 may be measured as the further distance between the inner surface and the outer surface of the top scales 44, 48. One skilled in the art will appreciate other methods to determine the width of the top scales 44, 48. In one embodiment, the width of the top scales 44, 48 is between approximately 5% and 200% the width of the tang end 28 of the blade 8. In a more preferred embodiment, the width of the top scales 44, 48 is between approximately 30% and 90% the width of the tang end 28 of the blade 8. In another preferred embodiment, the width of the top scales 44, 48 is greater than 5% the width of the tang end 28 of the blade 8. In a most preferred embodiment, the width of top scales 44, 48 is approximately 60% the width of the tang end 28 of the blade 8. One who is skilled in the art will appreciate that if there is more than one top scale 44, 48, the width of the top scales 44, 48 may be different from one another.

In various embodiments of the present invention, the top scales 44, 48 may be suited for a particular application. This allows a user to buy a top scale 44, 48, or even stacking scales 52, 56, as needed to suit the particular application of the knife 4, which may necessitate specific materials or other knife handle properties. Examples of materials used for their durability include amorphous thermoplastic terpolymer, carbon fiber, Kevlar®, garolite and other fiberglass-based laminates, Zytel®, and stainless steel. Micarta® is a composite in a thermosetting plastic that is often used for underwater applications. Other materials such as aluminum or titanium may be advantageous for their lightweight qualities. Other applications of knives 4 may be for only show or appearance, in which case materials such abalone, bone, leather, pearl and wood are commonly used. One skilled in the art will appreciate a variety of materials suited for particular applications. The benefit of a specialized top scale 44, 48 or stacking scale 52, 56 is that a user does not need to buy a completely new knife 4 for a different application.

Figure 8A:
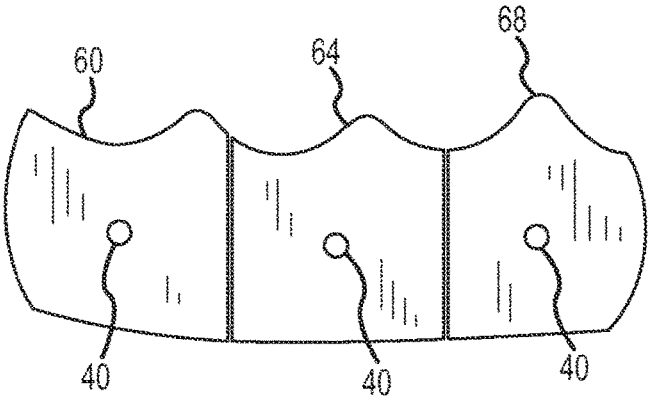
FIG. 8A is a side elevation view of a first stacking scale that is partitioned into three segments.
Figure 8B:
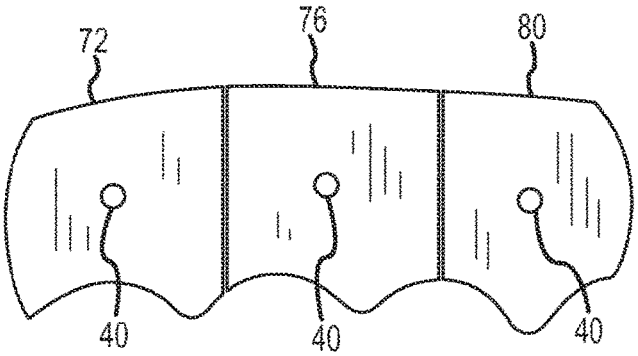
FIG. 8B is a side elevation view of a second stacking scale that is partitioned into three segments.

Now referring to FIGS. 8A and 8B, stacking scales that have been segmented into multiple columns are provided. The top scales 44, 48 and/or the stacking scales 52, 56 may be allocated on the tang end 28 of the blade 8 in discrete portions or columns. For example, one side of the handle could comprise three columns of stacking scales 52, 56 and top scales 44, 48: a fore column 60, 72 disposed proximate the choil 24, an aft column 68, 80 disposed proximate the second aperture 36, and a center column 64, 76 disposed between the fore column 60, 72 and the aft column 68, 80. A user may determine that it is advantageous to have the knife handle taper towards the rear of the knife 4, and thus a user would remove a number of fore columns 60, 72 from the stacking scales 52, 56 or even more fore columns 60, 72 and center columns 64, 76 from the stacking scales 52, 56 to create a handle shape that tapers towards the rear of the knife 4. Each column may have an individual top scale 44, 48 or a single top scale 44, 48 that may be flexible and span the entire tang end of the 28 of the blade 8. One skilled in the art will appreciate that the column concept of this invention is not necessarily limited to three columns, and a user may find it advantageous to have a greater number or a fewer number of columns. In further embodiments of the present invention, the various scales may comprise depressions or apertures for a user to place a finger or thumb, which increases the user's grip on the implement.

Figure 9:
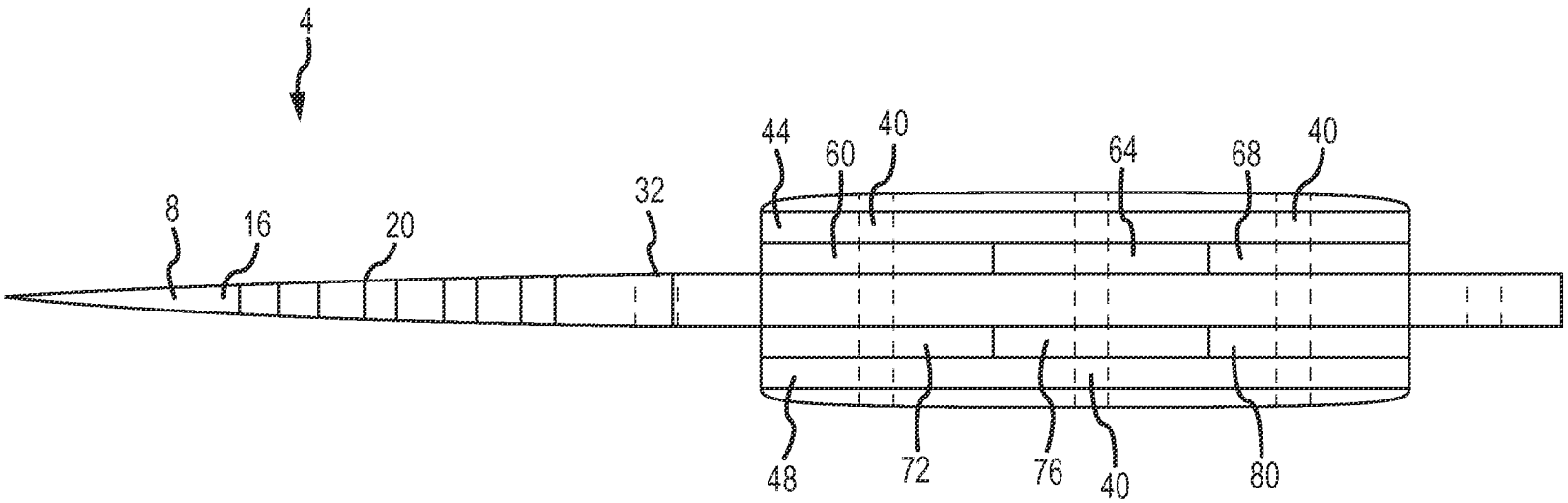
FIG. 9 is a top plane view of a knife with adjustable scales wherein the first and second stacking scales are partitioned into three segments.

Now referring to FIG. 9, an embodiment of the present invention comprising three columns of stacking scales 52, 56 is provided. In this embodiment, the first stacking scale is divided into a fore column 60, a center column 64, and an aft column 68. Similarly, the second stacking scale is divided into a fore column 72, a center column 76, and an aft column 80. In the embodiment depicted in FIG. 9, there are multiple fastener apertures 40 aligned on three axes, one axis per column. One skilled in the art will appreciate that other embodiments of the present invention that comprise segmented stacking scales may also have fastener apertures 40 configured in a staggered alignment, and one skilled in the art will appreciate that the segmented stacking scale scope may be used in combination with any other feature, concept, or aspect described elsewhere herein.

As discussed above, the present invention is not limited to fixed blade knives or even knives. In the typical folding knife design, the stacking scales 52, 56 and top scales 44, 48 would not interconnect to the tang end 28 of the blade 8, but to a back spacer or base scale in the handle of the folding knife. Further, the present invention is not limited to knives. Adjustable handles or scales are advantageous in a variety of applications where a user is grasping a handle. Example of devices that have handles include, but are not limited to, pistols, garden shears, multi-tools, hatchets, rackets, golf clubs, and hammers.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. A handtool having an adjustable handle, wherein at least one of the overall thickness and contour of said adjustable handle can be selectively altered, comprising:
- a handle end and a working end opposite said handle end, said handle end having a first side and a second side opposite said first side;
- a first scale assembly disposed on said first side of said handle end, wherein said first scale assembly comprises:
  - at least one stacking scale having at least two fastener apertures;
  - a top scale disposed on said at least one stacking scale of said first scale assembly, said top scale of said first scale assembly having at least two fastener apertures;
- a second scale assembly disposed on said second side of said handle end, wherein said second scale assembly comprises:
  - at least one stacking scale having at least two fastener apertures;
  - a top scale disposed on said at least one stacking scale of said second scale assembly, said top scale of said second scale assembly having at least two fastener apertures;
- wherein said fastener apertures of said at least one stacking scale and said top scale of said first scale assembly are arranged in a staggered configuration with respect to said fastener apertures of said at least one stacking scale and said top scale of said second scale assembly, and said fastener apertures are adapted to receive hardware for selectively, removably securing said stacking scales and said top scales to said handle end to alter the contour of said ad adjustable handle.

2. The handtool of claim 1, wherein each said at least one stacking scale comprises a fore discrete column disposed towards said working end of said handtool and an aft discrete column disposed towards said handle end of said handtool, wherein said discrete columns are selectively removable from each said at least one stacking scale to alter the contour of said adjustable handle.

3. The handtool of claim 1, wherein said handtool is a knife, said working end is a blade, and said handle end is a tang.

4. A system for providing an adjustable handle, wherein at least one of the overall thickness and contour of said adjustable handle can be selectively altered, comprising:

a handtool having a handle end and a working end opposite said handle end, said handle end having a first side and a second side opposite said first side, wherein said handle end has a width;

a first scale assembly disposed on said first side of said handle end, wherein said first scale assembly comprises:

at least one stacking scale having a fore discrete column disposed towards said working end of said handtool and an aft discrete column disposed towards said handle end of said handtool, wherein said discrete columns are selectively removable from said at least one stacking scale to alter the contour of said adjustable handle; and a top scale having a width, wherein said top scale is disposed on said at least one stacking scale.

5. The system of claim 4, wherein said at least one stacking scale and said top scale are made from at least one of amorphous thermoplastic terpolymer, carbon fiber, Kevlar®, garolite, Zytel®, stainless steel, Micarta®, aluminum, titanium, abalone, bone, leather, pearl, and wood.

6. The system of claim 4, wherein said at least one stacking scale, said top scale, and said handle end of said handtool each comprise at least two fastener apertures.

7. The system of claim 6, wherein said at least one stacking scale and said top scale are secured to said handle end of said handtool by at least one of rivets, bolts, adhesives, flat screws, Phillips screws, hex screws, Torx® screws, and spanner screws.

8. The system of claim 4, wherein an inner side and an outer side of said at least one stacking scale, an inner side of said top scale, and said first side of said handle end are substantially planar.

9. The system of claim 4, further comprising a second scale assembly disposed on said second side of said handle end, wherein said second scale assembly comprises:

at least one stacking scale; and a top scale wherein an inner side of said top scale of said second scale assembly is disposed on said at least one stacking scale of said second scale assembly.

10. The system of claim 9, wherein said at least one stacking scale of said first scale assembly, said at least one stacking scale of said second scale assembly, said top scale of said first scale assembly, said top scale of said second scale assembly, and said handle end of said handtool each comprise at least two fastener apertures, wherein said fastener apertures of said at least one stacking scale and said top scale of said first scale assembly are arranged in a staggered configuration with respect to said fastener apertures of said at least one stacking scale and said top scale of said second scale assembly, and said fastener apertures are adapted to receive hardware for selectively securing said stacking scales and said top scales to said handle end.

11. The system of claim 4, wherein said handtool is a knife, wherein said working end is a blade and said handle end is a tang.

* * * * *